US005707125A

United States Patent [19]

Coglin

[11] Patent Number: 5,707,125

[45] Date of Patent: Jan. 13, 1998

[54] WALL-MOUNTED STORAGE CABINET

[76] Inventor: James B. Coglin, 8787 Brae Acres #816, Houston, Tex. 77074

[21] Appl. No.: 712,590

[22] Filed: Sep. 13, 1996

[51] Int. Cl.[6] ..... A47B 67/02

[52] U.S. Cl. ..... 312/242; 312/245; 52/27; 52/36.4

[58] Field of Search ..... 312/242, 245; 52/27, 36.4; 411/389, 388, 378, 393

[56] References Cited

U.S. PATENT DOCUMENTS

| | | | |
|---|---|---|---|
| Re. 31,409 | 10/1983 | Crist | 312/242 |
| 742,012 | 10/1903 | Decker | 312/242 |
| 891,389 | 6/1908 | Watts | 52/36.4 X |
| 2,911,275 | 11/1959 | Wise | 312/242 |
| 4,076,350 | 2/1978 | Crist | 312/242 |
| 4,134,625 | 1/1979 | Palka | 312/245 X |
| 5,139,322 | 8/1992 | Aisley | 312/245 X |
| 5,368,378 | 11/1994 | Curtis | 312/242 X |
| 5,562,163 | 10/1996 | Sartain et al. | 312/242 X |
| 5,570,938 | 11/1996 | Butler | 312/245 X |
| 5,577,819 | 11/1996 | Olsen | 312/242 |

FOREIGN PATENT DOCUMENTS

| | | | |
|---|---|---|---|
| 2256938 | 5/1974 | Germany | 52/27 |
| 156412 | 8/1985 | Japan | 312/245 |
| 6701589 | 8/1968 | Netherlands | 312/245 |

*Primary Examiner*—Peter M. Cuomo
*Assistant Examiner*—Hanh Van Tran

[57] ABSTRACT

A space-saving wall-mounted cabinet and mounting method, for storing and/or displaying typical home items such as books, trophies, ornaments, linens, tools.

3 Claims, 3 Drawing Sheets

WALL-MOUNTED STORAGE CABINET

FIELD OF THE INVENTION

A typical home contains several self-standing cabinets to hold books, ornaments, utensils, tools, apparel, and other items so as to conserve floor space in an orderly manner and to enhance appearance of the home. Such cabinets for use in living rooms, dining rooms, dens, and bedrooms are usually positioned with their backs toward walls having baseboards mounted at the juncture of wallboard and floor so as to protect the wallboard from damage caused during movement of floor supported items, and to improve appearance of the wall-floor juncture. The legs of floor supported cabinets usually project laterally to the rear of the cabinet so as to prevent the cabinet from contacting and damaging the wall, and to improve appearances. Thus, the combined thickness of the baseboard and the lateral projection of the cabinet legs is lost for use as storage space for the entire width of the cabinet, causing a cabinet having a usable depth of 8" for instance, to project 9" from the wall. As every homekeeper knows, the space behind such self-standing cabinets collects dust that is difficult to remove.

Wall-mounted cabinets are rarely found in the larger rooms, but most homes contain wall-mounted cabinets in the kitchen, bathroom, utility room and garage to save the 1" of space, having backs fixed against the outer surface of wallboards. Room dimensions must be increased by 100% of the space required for such cabinets, which in turn increases the home cost for each square foot of increase, in order to maintain room between the cabinets and other furniture.

It is of national concern, that current home costs, denie a record number of citizens home ownership, so it is vital that means to reduce home costs and improve quality, be developed and utilized. More efficient utilization of space in the home in a manner that enhances both use, appearance and maintenence, is a way to that end.

DISCRIPTION OF RELATED ART

The best known type of recessed wall-mounted cabinet, perhaps exemplified by U.S. Pat. No. 5,399,008, is a bathroom medicine cabinet found in virtually every home for many years, being a metal flush-mounted cabinet with shelves and having a hinged door with a mirrored front wherein the shelf lateral depth is necessarily less than the wall stud width plus the wallboard thickness, which typically totals about four inches. A four inch shelf depth is sufficient to hold small articles such as toothbrushes, toothpaste, hair tonic and such, but is not sufficient for general use to hold such as books, trophies or rifles in a living area, or to hold such as power tools, gallon paint cans or fishing equipment in a garage area.

The closest related art known to applicant is U.S. Pat. No. 4,909,158 filed Feb. 11, 1988 and issued to Sorensen on Mar. 20, 1990. The patent is for "A combined wall cabinet and retractable ironing board for installation in an elongate, recessed opening in a wall between vertically aligned, spaced apart, support members such as studs". The ironing board cabinet has one shelf (62) best shown in FIG. No. 1, that was specifically positioned to serve primarily as a stop member to limit downward movement of panel (40) as depicted in FIG. 2, such that the panel is wedged between shelf (62), lower end wall (26) and the sheeting (18). Lower endwall (26) extends only a partial depth of the cabinet, so as to provide opening (32) sufficient to allow passage of panel (40) therethrough. Shelf (62) extends only partially toward the front of the cabinet so as to allow sufficient room for the panel to wedge between the shelf and door (38). Shelf (62) also serves to support board (66) which serves as a mounting for electrical outlet (68). When not in use, panel (40) is stored in both the wall cavity below the cabinet and within the cabinet as shown in FIG. 2. Space above shelf (62) is narrow and comprises a very small portion of the cabinet volume and therefore, the cabinet is not suitable to store general household items. Sorensen's sidewalls (22) are attached to mutually adjacent studs (12) by the use of nails or screws, which may be sufficient to support the very light weight of his cabinet and ironing board, but not sufficient to support for instance, weight of a cabinet full of books placed on several wide shelves, especially if the studs are crooked and/or irregularly spaced. The cabinet must be less than the space between the studs for installation, and any excess clearance caused by spacing or crookedness of the studs, may cause the cabinet weight to bend and pull out the nails or screws. Other related art is depicted in patents as follows: U.S. Pat. No. 1,428,819 issued to Simonson on Feb. 5, 1924; U.S. Pat. No. 1,473,345 issued to Hess on Nov. 6, 1923; U.S. Pat. No. 1,423,707 issued to Prost on Sep. 12, 1922; and U.S. Pat. No. 1,966,800 issued to Katzman on Jul. 17, 1934.

SUMMARY OF THE INVENTION

The present invention provides a space-efficient, wall-mounted cabinet for the living room, dining room, kitchen, bedroom, hall and/or garage, that is suitable for storage or display of general household items such as books, ornaments, trophies, rifles, linens, tools or supplies.

The rear portion of the cabinet is installed through a properly sized opening cut through the wallboard into the wall cavity between conventional wall support members such as studs, with the lateral depth of the cabinet substantially exceeding, the lateral depth of the wall cavity measured from the near surface of the wall to the near surface of the wallboard on the opposite side of the wall, such that the lateral depth of the cabinet shelves is sufficient to receive general household items that may be placed on the bottom wall of the cabinet and/or shelves positioned intermediate the top and bottom endwalls. When the cabinet base is positioned near the floor, vertical support for the cabinet to support such as the weight of several shelves of books, may be provided by partial length studs inserted within the wall to extend from the wall's floor plate upwardly to a member mounted horizontally at the proper level to support the lowermost wall of the cabinet at the desired position of installation. Minor lateral support for the cabinet may be provided by driving nails or screws through the cabinet side walls into the adjacent studs, but because the distance between the studs may vary, care should be exercised when installing the lateral supports so as to not distort the cabinet side walls outwardly, and away from the shelves.

The present invention provides hidden lateral support method and means to prevent such distortion of the sidewalls outwardly and when desired, may be used for vertical support of the cabinet also. Such means includes headless screws driven into pilot holes extending laterally through the cabinet sidewalls into the adjacent studs respectively, until the screws are past the inner surface of the cabinet sidewalls, such that the screws are not visible to one standing in front of the cabinet. Because the screws are then threaded into both the sidewall and into the stud, movement of the cabinet is restrained in all directions. If the cabinet weight is supported at the bottom wall, then for instance, only lateral movement need be restrained by such screws, so a single small screw through the sidewall near each comer of the cabinet may suffice. However, if substantial weight is to be supported by such screws, then the size and number of screws used, must be selected sufficient for that load.

The cabinet may be provided with an exoskeleton affixed around it's periphery so as to maintain its shape during transport, installation, handling and to add strength to the cabinet walls after installation, so as to assist in support of heavy loads placed within the cabinet. The exoskeleton also serves to position the cabinet parallel with the wall so as to project a desired dimension into the wall cavity for installation, and to serve as ornamentation for visual improvement of the installed cabinet.

The overall height of the cabinet, or exoskeleton when used, may be any suitable dimension less than the height of the wall on which it is to be installed. For easiest installation, the lowermost portion of the cabinet should be mounted above the wall's baseboard, but when desired, the baseboard may be cut for the cabinet to extend to and mount on the floor.

The width of the cabinet may be dimensioned for insertion between two adjacent studs set normally sixteen inches between centers for easiest installation. However as an alternative, it may sometimes be dimensioned to fit between studs such as 32, 48 or 64 inches on center in which case, portions of the intervening studs must be removed from the wall so as to fully form the cavity. Particularly in load bearing walls, conventional headers as used over windows and doors may be required above where the stud portions were removed, to support loads that the removed portions would have supported. For a given installation, the cabinet width, it's height and it's elevation to be installed, will depend on the wall space available and on buyer preferences.

Depending on the items to be stored within the cabinet of the present invention, it may be installed with no door, or provided with a glass door so as to continually display contents such as books, trophies, rifles or dishes. For storage of items not visually desirable such as linens, tools and staples, the cabinet may be provided with an opaque door.

By way of example, to provide a cabinet having an 8" lateral depth in a home having studs typically three and one half inches wide and wallboard one-half inch thick, the wall cavity would have a 4" lateral depth, so the cabinet of the present invention would project only four inches into a room, which effects a 55% savings of floor area as compared to the conventional cabinet described above which projects nine inches into the room. Of even greater importance, the five inch savings will allow installation of my cabinet in many tight areas such as halls and small rooms, that cannot now reasonably receive a conventional cabinet.

The cabinet is best provided as a preassembled article of manufacture for installation by home carpenters not skilled in cabinet making, so as to reduce costs, save time on the job, improve cabinet availability and quality, such that any craftsman need only cut a hole in the wail and install it during construction of the house, or benefit it later. However, under special circumstances such as the need to use special materials or dimensions to match the house, it may be desirable for a cabinetmaker to build the cabinet on site.

DESCRIPTION OF PREFERRED EMBODIMENTS

Figure 1:
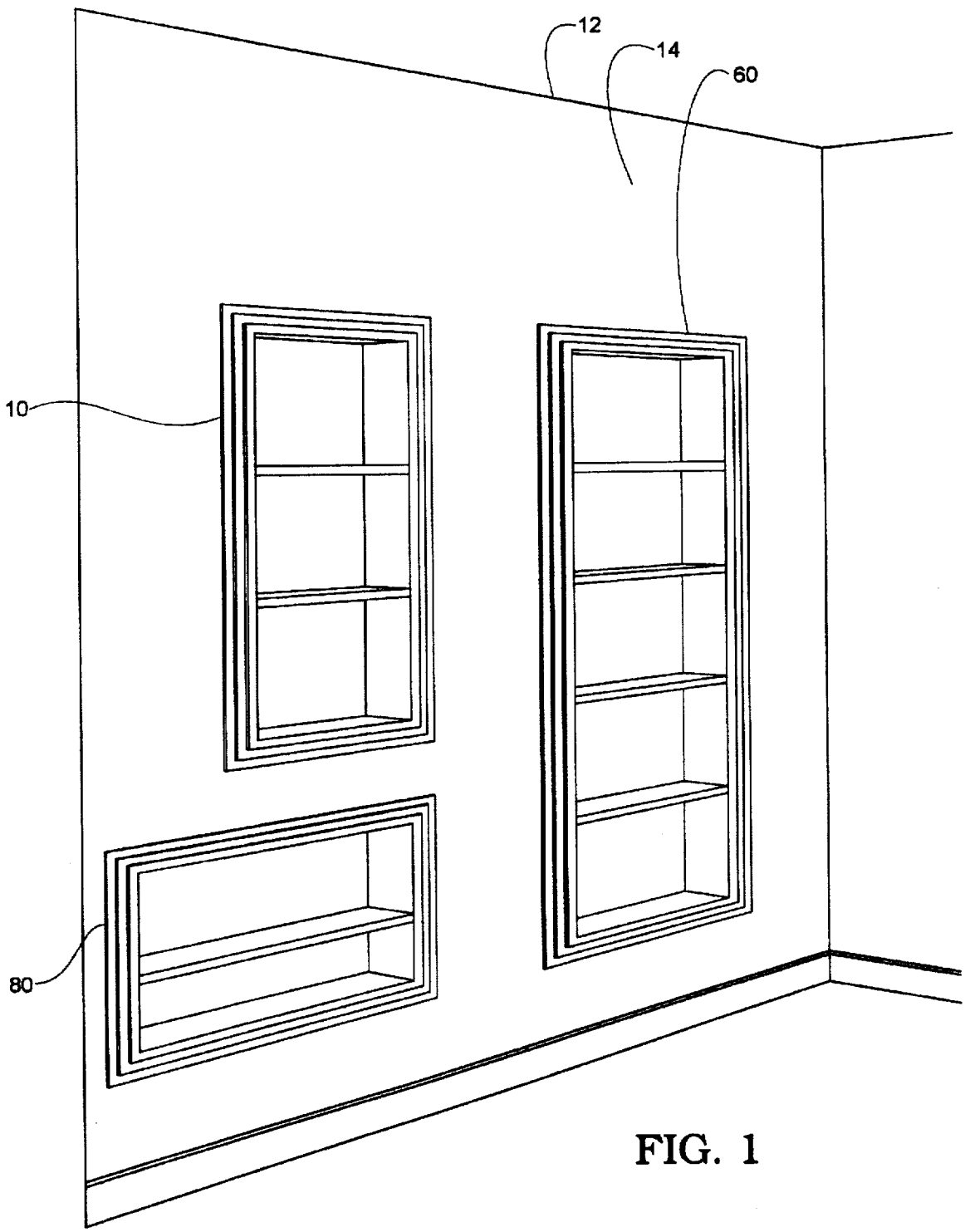
FIG. 1 is a 10 degree perspective view at eyelevel, of three configurations of the invention shown mounted on a common wall.

FIG. 1 depicts three configurations for the present invention, designated by the numbers 10, 60 and 80, mounted in wall 12 having wall surface 14. Other shapes may be utilized depending on the wall space available and buyer preference without departing from the spirit of the invention.

Cabinet 10 has a height suitable for use to further conserve space when other furniture such as a chair or table is placed near the wall. Cabinet 60 has a height suitable for use to hold such as many books, where no other furniture is planned to be located nearby. The widths of cabinets 10 and 60 may be dimensioned for insertion and installation between vertical support members in the wall, referred to hereinafter for illustration as studs, typically positioned in the wall on 16' centers.

Cabinet 80 is configured for typical installation in a non-load bearing wall because it's width is dimensioned wider than between the distance the rear surfaces studs on 16" centers, which requires removal of portions of intervening studs from the wall before the cabinet can be partially inserted into and mounted with the wall.

Figure 2:
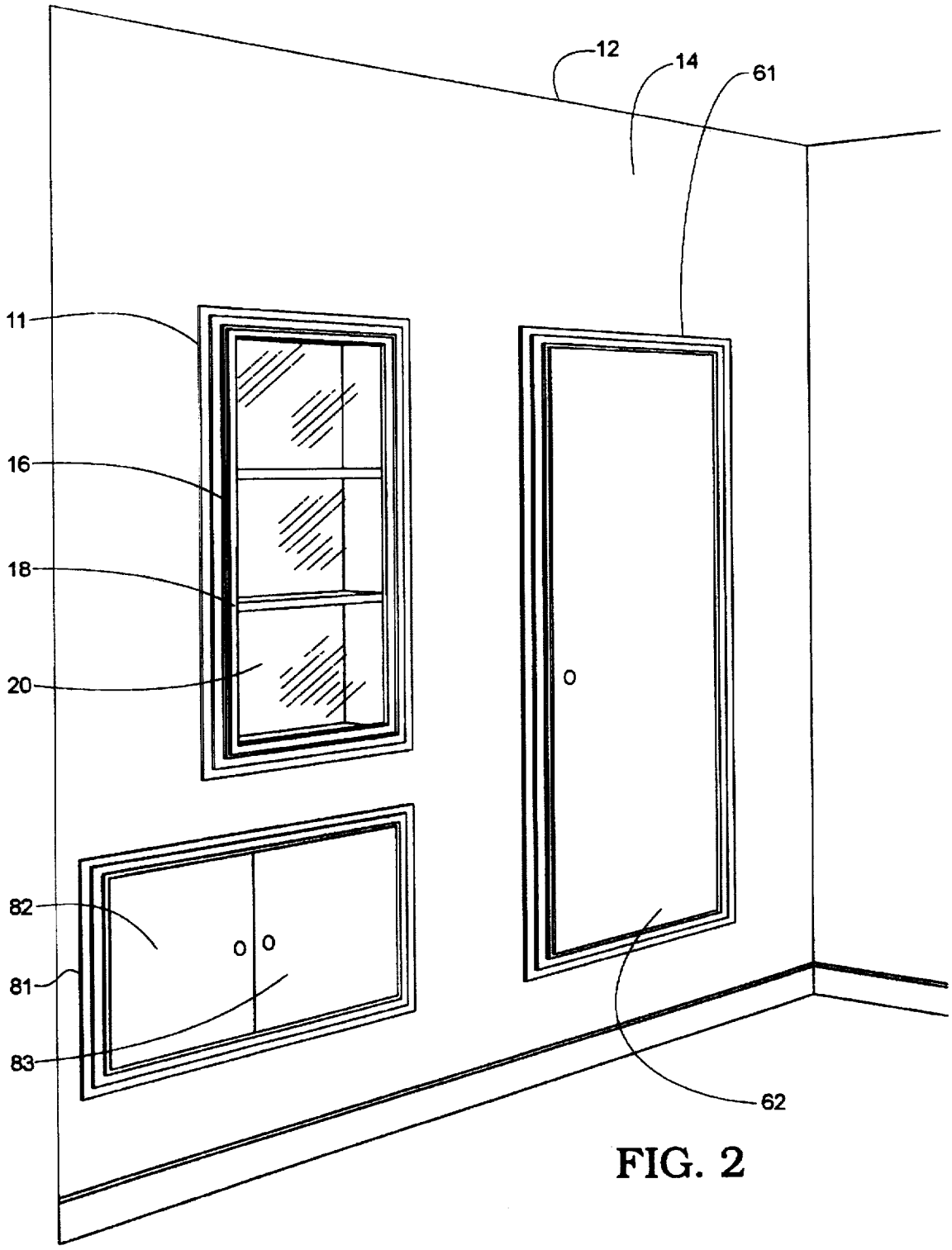
FIG. 2 depicts the three configurations of FIG. 1 when they are provided with a glass door, a solid door, and two solid doors respectively.

FIG. 2 illustrates how cabinets having configurations of the cabinets of FIG. 1 may appear when provided with doors. Cabinet 11 is shown with conventional door 16 having wooden frame 18 within which glass panel 20 is mounted, such that contents on the shelves such as books, dishes or trophies are continually displayed as well as stored. Cabinet 61 is shown provided with a conventional hinged door 62 and cabinet 81 is provided with conventional hinged doors depicted as at 82 & 83.

FIGS. 3–6 are views of the present invention, used to detail all features of the invention, except configuration. Cabinet shelves such as at 22 may be fixed, or may be adjustable in height and/or in the number of shelves. Such adjustments may be provided in any conventional manner, such as by a plurality of metal pegs 24 inserted into mating holes as at 26 positioned laterally into the inner surface of the sidewalls 28 & 29 immediately below the lower surface as at 30 of each shelf end as at 32 for which support is required, when the shelf is positioned as desired.

In addition to the shelves, primary cabinet members include sidewall 34, sidewall 36, topwall 38 and bottomwall 413 and panel 42 which forms the back of the cabinet. The bottomwall also forms a shelf.

Exoskeleton 44 may be affixed around the cabinet perimeter 46 formed by outer surfaces of walls 34, 36, 38, and 413, of sufficient dimension to strengthen the cabinet against distortion during transport, handling, installation and against the loads imposed by items that the cabinet may later contain. Execoskeleton 44 is shown having an "L" shaped cross-section in FIG. 4, but it may be formed with any cross-section having the required strength and characteristics to provide the following features. The exoskeleton may also serve to position the cabinet parallel to the wall for installation when it's rear surface 48 abuts wall surface 14 around perimeter 46, such that panel 42 projects a predetermined desired amount into wall cavity 15. Surface 48 is dimensioned sufficiently wide such that perimeter 46 overlaps perimeter 19 of cavity 15, so the exoskeleton will hide from view gap 17 of varying width, the gap being formed between perimeter 46 and perimeter 19 defined by edges 9 of wallboard 13.

For illustration of a typical installation of the present invention, a common wall construction is depicted, comprising: wooden studs 51 and 52 having horizontal dimensions of 1.625" parallel to wall surface 14 and 3.5" perpendicular thereto, the studs being positioned vertically on 16" centers with their 1.625" sides being parallel to the plane of wall surface 14; ½" thick wallboard 13 affixed to the near side of the studs and ½" thick wallboard 8 affixed to the far sides of the studs. The lateral dimension between the studs is then 14⅜", and the width of the cabinet rectangle to be positioned between them must be less by an amount to allow for accumulated dimensional tolerances. If cavity 15 is cut 14⅜" wide in wall board 14 and the outside lateral width across the sidewalls is chosen to be 14" then on average, gap 17 will be 3/16" wide. Should conventional nails or screws be driven through the sidewalls into the adjacent studs in an effort to support the cabinet, the sidewalls would be pulled outwardly away from the shelves into the gap, thereby weakening support for the shelves and causing visible distortion of the cabinet.

Figure 5:
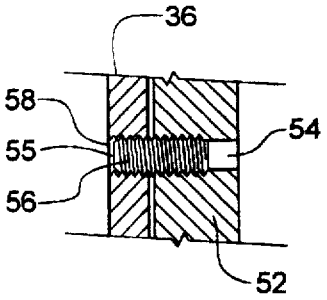
FIG. 5 is a fragmentary section taken along 5—5 of FIG. 4.
Figure 4:
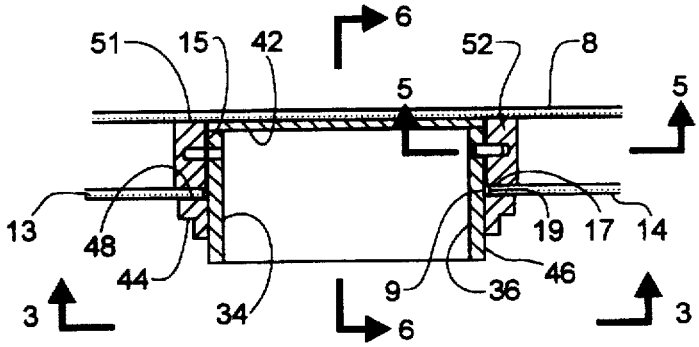
FIG. 4 is a top section taken along 4—4 of FIG. 3.
Figure 6:
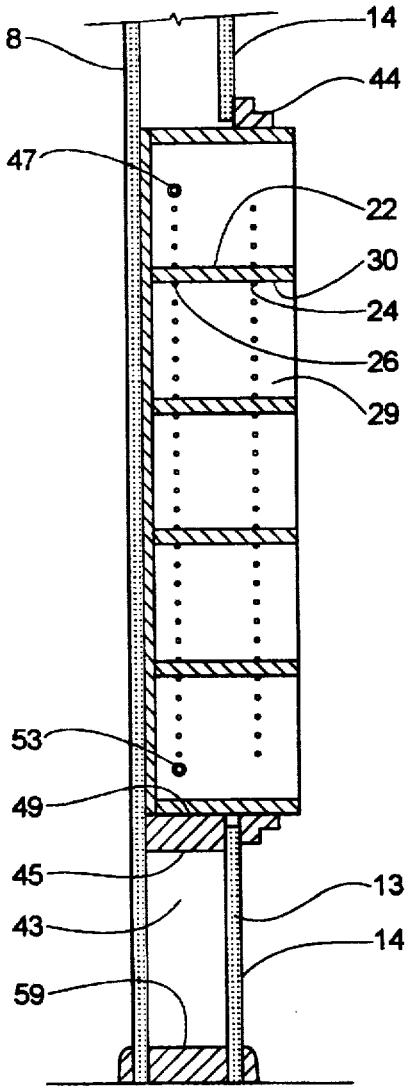
FIG. 6 is a side section taken along 6—6 of FIG. 4.

The present invention provides means to attach the sidewalls to the adjacent as shown in FIG. 5, against movement in all directions without distortion of the cabinet described above. Pilot hole 54 may be drilled through sidewall 36 and stud 52 after which, headless screw 56 is threaded into the pilot hole until end 55 of screw 56 passes surface 29 of sidewall 36, so as to be hidden as viewed from the front of the cabinet. Should it be desired to completely hide screw 56 from view, then a conventional adhesive plug having similar color to the cabinet sidewall, may be applied as shown at 58. The number of screws required to secure the cabinet in position will depend on the weight of the cabinet and contents to be supported by the screws, however, it is recommended that no less than two such screws as shown positioned at 47 and 53 of FIG. 6, be installed in each sidewall.

Figure 3:
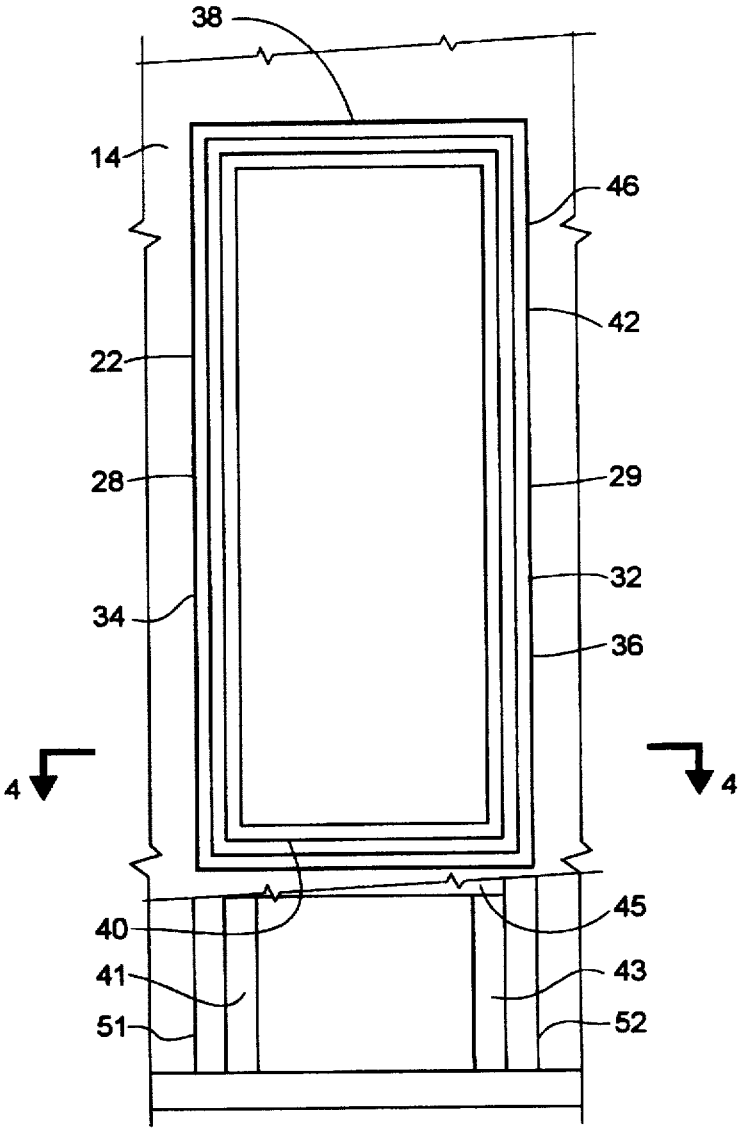
FIG. 3 is a frontal view of one configuration of the invention after installation.

When a cabinet configuration such as depicted at 60 is used to support very heavy weights, additional vertical support for the cabinet may be provided as shown in FIG. 3, by insertion of partial length studs 41 and 43 of predetermined dimension to support a remnant from a stud, dimensioned to fit between studs 51 and 52 and on top of members 41 and 43, member 45 then being positioned level at the desired height for the rear portion of lower endwall 40 to rest upon when the cabinet is at the desired position for installation.

The normal procedure for installation of the cabinet may be as follows. A rectangular opening is cut through wallboard 13 to form cavity 15 having perimeter 19 of sufficient width and height to receive cabinet perimeter 46, but less than the perimeter of the exoskeleton. In additional vertical support for the cabinet as described immediately above is to be used, members 41 and 43 are inserted into the cavity and lowered into position so as to rest on wall plate member 59 and to abut studs 51 and 52 respectively, to which they are then attached. Member 45 is then mounted on top of members 41 and 43, such that upper surface 49 of member 45 is level and at the desired elevation to support lower endwall 40 in the position of installation. The cabinet is then moved into the position of installation such that the rear portion of the cabinet is within the cavity and panel 42 is near and parallel to wallboard 8. If the cabinet comprises an exoskeleton, surface 48 will then abut wall surface 14. The cabinet should then be temporarily supported in the position of installation by any suitable means such as by member 45, while screws are installed through the sidewalls and into the studs as previously described.

When a cabinet is to be supported without use of member 45, then any suitable temporary means of support may be used to hold the cabinet only in the desired position for installation, such as by nails partially driven through peg holes in opposite sidewalls, into the respective stud. After permanently affixing the cabinet in position as by a plurality of screws 56 or any other means, the partially driven nails may be removed. After a cabinet not having an exoskeleton is mounted, gap 17 will usually be covered by such as wall texture when it is applied to the wallboard, or by strips of moulding nailed against the wall around perimeter 46.

It is now clear how a cabinet may be provided to save floor space, time and cost in a home and in some cases, may make possible additional storage space in areas that may not otherwise be possible.

I claim:

1. A pre-fabricated wooden cabinet which mounts partially within a mating cavity formed in a wall structure having wallboard affixed to vertical studs, the cabinet having as primary members a top wall, a bottom wall, a left side wall, a right side wall, and a back panel forming a frontal surface comprising: an exoskeleton affixed around a periphery of the cabinet formed by the four walls, such that no gap exists between the walls and the exoskeleton; the exoskeleton being of sufficient strength so as to prevent damage to and visible distortion of the cabinet during handling, transport, installation and use; the exoskeleton being positioned parallel to and a desired first dimension from the back panel, such that when the back panel is fully inserted into the wall cavity, the exoskeleton abuts the wallboard with no gap therebetween, and the front surface is positioned parallel to and a desired second dimension away from the wallboard; the second dimension being at least one-half the magnitude of the first dimension so as to provide a working depth within the cabinet, extending between the back panel and the front surface, of at least 150% of the first dimension; means for mounting the cabinet wherein one or more headless screws are engaged in threaded contact with each side wall and it's respectively adjacent stud.

2. The cabinet of claim 1, further comprising: the width of the exoskeleton as measured parallel to the wall surface, being of sufficient dimension so as to hide the wall cavity from view.

3. A method for mounting a cabinet between two parallel vertical support members such as housing wall studs whose position and orientation vary within normal construction tolerances, the cabinet having a left side wall and a right side wall affixed relative to each other such that the dimension between the outer surfaces of the side walls is slightly less than the standard lateral distance between the studs, comprising: positioning the cabinet between two studs as desired for mounting; forming one or more pilot holes through each side wall and into the stud there adjacent, such that each hole in the side walls can be simultaneously aligned with it's respective hole in the adjacent stud; driving headless screws of larger diameter than the pilot holes, into the pilot holes such that threaded engagement is effected by each screw between both the side wall and the stud respectively; such that relative movement between the cabinet and the studs is restrained in all directions; such that no tendency is created for the side walls to be pulled outwardly and away from each other, as could occur were a headed screw used; such that the cabinet is fixed against movement toward and away from the studs, as could occur were pins used.

* * * * *